United States Patent [19]

Seki et al.

[11] Patent Number: 4,913,624

[45] Date of Patent: Apr. 3, 1990

[54] LOW PULSATION DISPLACEMENT PUMP

[75] Inventors: Kiwao Seki; Tsuyoshi Nishitarumizu, both of Katsuta, Japan

[73] Assignee: Hitachi, Ltd., Tokyo, Japan

[21] Appl. No.: 228,749

[22] Filed: Aug. 5, 1988

[30] Foreign Application Priority Data

Aug. 11, 1987 [JP] Japan ..... 62-200488

[51] Int. Cl.[4] ..... F04B 11/00

[52] U.S. Cl. ..... 417/2; 417/15; 417/16; 417/44; 417/53

[58] Field of Search ..... 417/2, 15, 16, 53, 38, 417/44; 210/101

[56] References Cited

U.S. PATENT DOCUMENTS

| | | | |
|---|---|---|---|
| 4,137,011 | 1/1979 | Rock | 417/22 |
| 4,352,636 | 10/1982 | Patterson et al. | 417/53 |
| 4,448,692 | 5/1984 | Nakamoto et al. | 417/18 |
| 4,507,055 | 3/1985 | Fair et al. | 417/53 |
| 4,600,365 | 7/1986 | Riggenmann | 417/246 |
| 4,681,513 | 7/1987 | Saito et al. | 417/2 |
| 4,772,388 | 9/1988 | Allington | 210/101 |

FOREIGN PATENT DOCUMENTS

| | | | |
|---|---|---|---|
| 0178569 | 8/1986 | Japan | 417/265 |

*Primary Examiner*—Carlton R. Croyle
*Assistant Examiner*—D. Scheuermann
*Attorney, Agent, or Firm*—Antonelli, Terry & Wands

[57] ABSTRACT

A low pulsation displacement pump has a pair of plungers and motor driven-cams or feed screws for reciprocating the plungers. In order to cause the pump to stably discharge a liquid so that variation in discharge due to machining errors of the plungers or the feed screws is eliminated, the pump discharge pressure is measured at each of a plurality of predetermined operative positions of the plungers before delivery of the pump from a manufacturing plant, and machining errors are obtained in accordance with the thus-measured discharge pressure. Then, the speed correction factor for the motor is calculated for each of the plurality of predetermined positions of the plungers in accordance with the thus-obtained errors to store the results of the calculation in a memory. When the pump is used, the motor is operated while the speed of the motor is compensated for at each of the plurality of predetermined positions of the plungers in accordance with the speed correction factor stored in the memory, whereby the rate of discharge of pump can be kept substantially constant by preventing speed variation of the plungers due to machining error of the cams.

11 Claims, 6 Drawing Sheets

LOW PULSATION DISPLACEMENT PUMP

BACKGROUND OF THE INVENTION

1. Field of the invention

This invention relates to a reciprocating fluid pump and, more particularly, to a low pulsation displacement pump having a discharge stabilizing function which is suitable for use in analyzing devices.

2. Description of the prior art

The low pulsation displacement pump of the type disclosed in U.S. Pat. No. 4,600,365 is structured to conduct suction and discharge in such a manner that a pair of plungers are alternately and complementarily operated by means of cams. In a pump of the type referred to above, the shape of the cam is specifically designed to reduce generation of pulsating flow and thereby to keep constant the composite discharge effected by operation of the two plungers.

However, in the above-described prior art, the accuracy of discharge depends upon the accuracy of the machined parts, such as cams and plungers. This raises a problem that the fluid discharge cannot be stabilized to a degree which exceeds the accuracy of manufactured parts.

To deal with this, a method could be conceived in which past errors are stored in a memory and the fluid discharge is compensated in accordance with this stored data. In this method, the discharge pressure is measured and any variation is used to compensate the rotational speed in a succeeding rotational cycle of the cams. However, in the practical analysis, there is another problem that other factors which influence accuracy are involved, such as entrapment of air bubbles and valve-switching noise. It is, therefore, difficult to conduct ideal error correction. Furthermore, the method of correction which depends upon past data raises a problem that the reproducibility which is necessary for analyzing devices is lowered.

Therefore, a low pulsation pump was disclosed in U.S. Pat. Application Ser. No. 111,640 by Taro NOGAMI et al (and in EP Application No. 87115449.8). This low pulsation pump conducts the correction of fluid discharge only in the period of suction and discharge where a large ripple effect is involved. In this low pulsation pump, however, the accuracy of the fluid discharge in other periods depends upon the accuracy of machined cams. This leads to the fact that any error in the manufacture of cams causes a variation in the fluid discharge of the pump.

SUMMARY OF THE INVENTION

An object of the present invention is to provide a low pulsation displacement pump which can overcome the above-described problems and in which fluid flow variations due to manufacturing errors of the plunger and the driving means therefor can be compensated to ensure that fluids are pumped stably.

Another object of the present invention is to provide a method of operating a low pulsation displacement pump comprising plungers and driving means therefor which method is effective to cause the pump to discharge fluids stably by restricting any variation in fluid discharge of the pump even if the plungers and the plunger driving means involve manufacturing errors.

A further object of the present invention is to provide a low pulsation displacement pump having a structure which achieves the method.

The method according to the present invention is to operate a pump of the type that has at least one plunger and means for reciprocating the plunger so that the liquid is sucked and discharged by the reciprocating movements of the plunger. The method comprises the steps of measuring errors in the amount of driving movement of the driving means at each of a plurality of predetermined operative positions of the plunger, calculating a speed correction factor of the driving means for each of the plurality of predetermined operative positions of the plunger in accordance with the thus measured errors and then storing results of the calculation in a memory, and operating the driving means while the speed of the driving means is adjusted at each of the plurality of predetermined operative positions of the plunger so that the speed of the plunger is compensated substantially to meet a designed value for thereby making the rate of discharge of the pump substantially constant.

The pump according to the present invention is of a low pulsation displacement type and comprises at least one plunger, driving means for reciprocating the plunger, memory means which stores therein a speed correction factor of the driving means for each of a plurality of predetermined operative positions of the plunger. The speed correction factor has been calculated in accordance with errors in the amount of driving movement of the driving means at each of the plurality of predetermined positions of the plunger. The pump further includes control means for controlling the speed of the driving means in accordance with the speed correction factor. The controlling means is operative to actuate the driving means so that the speed of the driving means is adjusted at each of the plurality of predetermined operative positions of the plunger in accordance with the speed correction factor stored in the memory means so that the speed of the plunger is compensated substantially to a designed value and the rate of the discharge of the pump is kept substantially constant.

In the pump and the method of operating the same according to the present invention, the correction factor for correcting any variation in discharge due to manufacturing errors in the component parts of the plunger driving means, such as cams and plungers, can be set for the pump at the manufacturing plant before delivery of the pump. As a result, since the user is not required to conduct correction during or before analysis operation, the reproducibility of analysis will not deteriorate.

The above and other objects, features and advantages of the invention will be made more apparent from the following detailed description with reference to the accompanying drawing.

DESCRIPTION OF PREFERRED EMBODIMENTS

Figure 1:
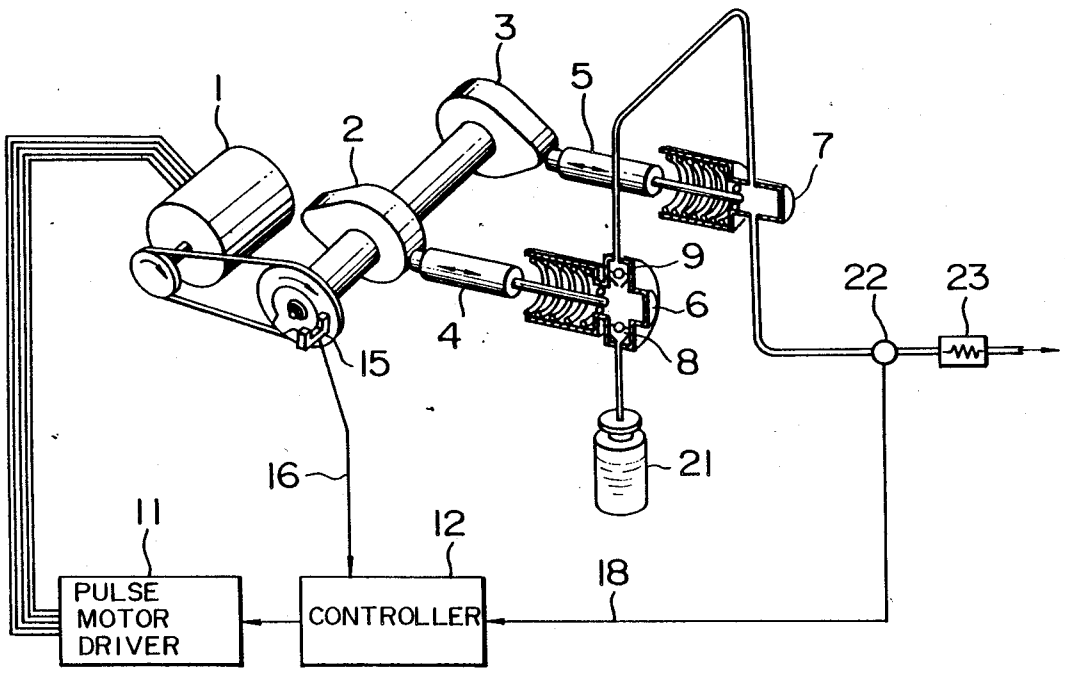
FIG. 1 is a schematic illustration of an embodiment of a low pulsation displacement pump according to the present invention.

A flow pulsation displacement pump shown in FIG. 1 is used for pumping a liquid solvent from a liquid container 21 for the purpose of passing the solvent through a fluid resistance 23 such as a separation column of a liquid chromatography. The low pulsation displacement pump comprises a pulse motor 1, a pair of cams 2 and 3 rotated by the motor 1, and plungers 4 and 5 which are disposed in cylinders 6 and 7 in such a manner that they can be reciprocated by the cams 2 and 3, respectively. An intake port of the first cylinder 6 is connected to the solvent container 21, while the outlet port of the first cylinder 6 is connected to an intake port of the second cylinder 7, and the outlet port of the second cylinder 7 is connected to the fluid resistance 23 via a pressure sensor 22. The intake port of the first cylinder 6 is provided with a first check valve 8, while the outlet port of the cylinder 6 is provided with a second check valve 9. The reciprocating movement of the plungers 4 and 5 causes suction of fluid into the cylinders 6 and 7 and discharge of the fluid from these cylinders. The cams 2 and 3 are disposed with the phase thereof offset with each other. The check valves 8 and 9 are arranged to cause the fluid to flow in one direction only. Therefore, the fluid can be continuously and constantly discharged due to constant rotation of the pulse motor 1.

FIGS. 3A to 3D illustrate the principle of the suction and discharge of the pump. The two plungers 4 and 5 are successively operated, as shown in FIGS. 3A, 3B, 3C and 3D, and the two check valves 8 and 9 are also successively operated as illustrated. As a result, the pump continuously sucks and discharges the fluid so that the fluid is continuously pumped to an aimed position.

The structure and the operation of the pump are well known, for example, from the above-described U.S. Pat. No. 4,600,465. Therefore, any further description is omitted.

Figure 4A:
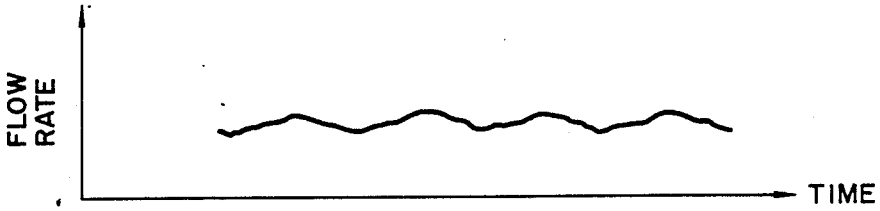
FIGS. 4A and 4B are graphs illustrating the fluid discharge characteristics of the conventional pump and of the pump shown in FIG. 1.

In a pump of the type described above, the cams thereof are designed in shape so as to make the speed of the plungers constant for the purpose of making fluid discharge constant. However, in practice, machining of a cam involves certain errors, which leads to a fact that the speed of the plungers cannot be made constant due to the machining error of the cams. As a result, the fluid discharge varies as shown in FIG. 4A. The variation is caused in synchronization with the rotation of the cams.

Principle Of the Compensation Of Fluid Discharge

The principle to be described forms an essential portion of the present invention. The discharge pressure is in proportion to the rate of discharge in a case where fluid resistance is constant:

$$P=R\cdot f \tag{1}$$

where R represents fluid resistance, f represents rate of discharge, and P represents discharge pressure.

The rate of the discharge f in the case of a reciprocating pump is the amount of increase in the plunger volume in a cylinder per unit of time period t and, therefore, represented by:

$$f=dV/dt \tag{2}$$

where V represents a plunger volume in the cylinder.

Since the increase in plunger volume in the cylinder is caused when the cam pushes the plunger, the rate of discharge f can be expressed as follows:

$$f = S\cdot\frac{dr}{dt} = S\cdot\frac{dr}{d\theta}\cdot\frac{d\theta}{dt} \tag{3}$$

where

S is the cross sectional area of the plunger;

$\theta$ is the angle of rotation of the cam; and r is the radius of the cam.

Furthermore, the radius r of the cam can be expressed as a function of angles, as follows:

$$r=r(\theta) \tag{4}$$

Therefore, $$f = S\cdot\frac{dr(\theta)}{d\theta}\cdot\frac{d\theta}{dt} \tag{5}$$

where $$\frac{d\theta}{dt}$$

represents the speed of a motor for driving the cams which is a constant value in proportion to a rate of discharge which has been set.

$$r = S\cdot C(F)\cdot\frac{dr(\theta)}{d\theta} \tag{6}$$

where F is the rate of discharge which has been set and C(F) is constant in proportion to the rate of discharge which has been set.

An ideal pump is designed to make $$\frac{dr(\theta)}{d\theta}$$

constant, $$\frac{dr(\theta)}{d\theta}$$

is represented by k. Therefore, $$f=S\cdot k\cdot C(F) \tag{7}$$

$$r(\theta)=k\theta \tag{8}$$

where k is constant representing the inclination of the cam {equivalent to $dr/d\theta$ in equation (3)}.

However, in an actual pump, there are error factors as follows:

(1) non-uniform diameter of plungers;

(2) manufacturing errors of cams;

(3) operation delay of check valves; and (4) variation of the time of switching suction and discharge due to the variation in the compressibility of fluids.

The factors (1) and (2) of the above mentioned factors form particularly major error factors.

The error factor (1) means that the diameter of the plunger is not constant but varied at different portions thereof depending upon the location; that is, the factor (1) is a function of the angle of rotation $\theta$ of the cam.

The error factor (2) means that the slope of the cam is not constant but varied depending upon the angle; that is the factor (2) means that k is a function of the cam rotational angle $\theta$.

In an actual pump, therefore, the rate of discharge f in equation (7) is also a function of $\theta$ as follows:

$$F(\theta) = S(\theta) \cdot k(\theta) \cdot C(F) \quad (9)$$

$$= k(\theta) \cdot S \cdot k \cdot c(F) \quad (10)$$

As a result, the discharge pressure {equation (1)} is also a function of the cam rotational angle $\theta$:

$$P(\theta) = R \cdot f(\theta) \quad (11)$$
$$= R \cdot (K(\theta) \cdot S \cdot k \cdot c(F)$$

The mean discharge pressure per rotation is calculated as follows:

$$Pmean = R \cdot S \cdot k \cdot C(F) \quad (12)$$

From the equations (11) and (12), following equation can be obtained:

$p(\theta)/Pmean = K(\theta)$ and, thus, $$k(\theta) = P(\theta)/Pmean \quad (13)$$

In order to stabilize the rate of discharge of the actual pump, $K(\theta)$ in the equation (10) needs to be made 1. This can be achieved by conducting compensation by multiplying $1/k(\theta)$ as shown in the following equation:

$$f(\theta) = K(\theta) \cdot S \cdot K \cdot C(F) \cdot \frac{1}{K(\theta)} \quad (14)$$

This means that the element C(F) is compensated as a function of $\theta$. Expressing the compensated C(F) by C(F, $\theta$), the following equation can be obtained:

$$C(F, \theta) = C(F)/K(\theta) \quad (15)$$

From the equations (3) and (7), C(F) is $$\frac{d\theta}{dt}$$

and, thus, is rotational speed of the motor. Therefore, the major variation factors can be removed by compensating the rotational speed.

Figure 2:
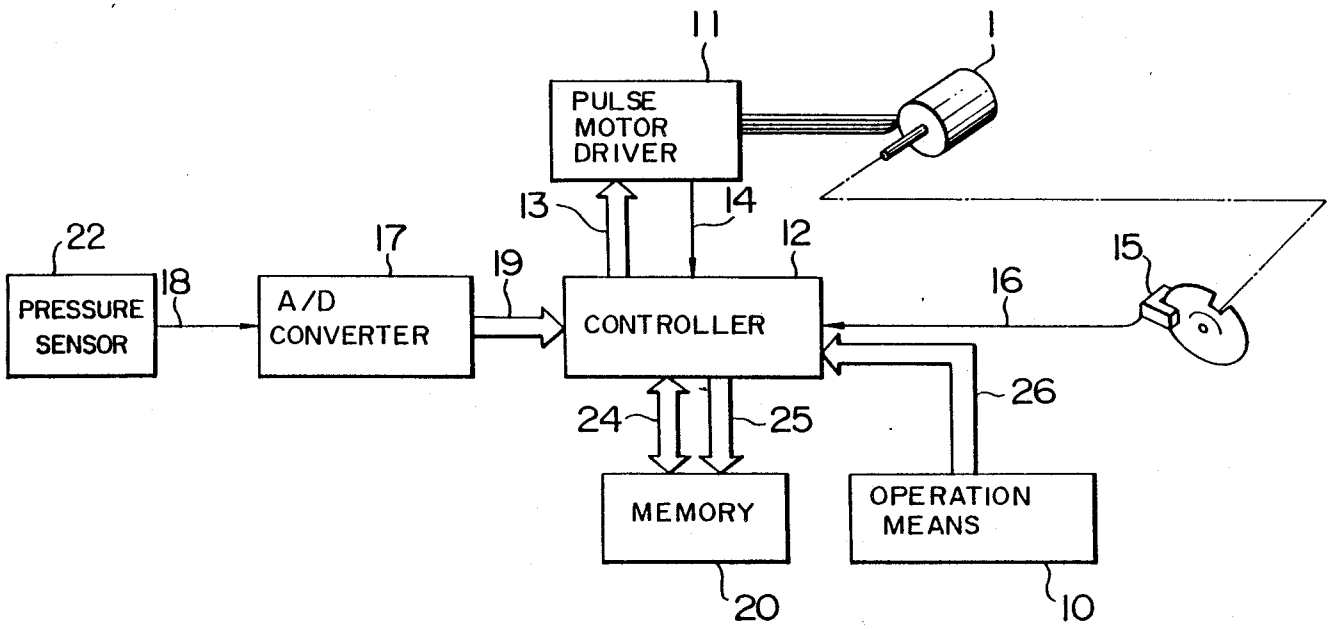
FIG. 2 is a block diagram of a control device of the pump shown in FIG. 1.
Figure 3A:
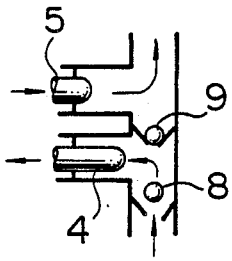
FIGS. 3A to 3D schematically illustrate the principle of the fluid pumping action of the pump shown in FIG. 1.
Figure 3B:
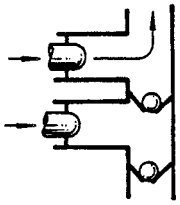
Figure 3C:
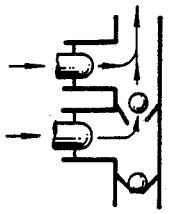
Figure 3D:
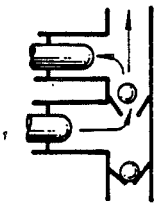

FIG. 2 shows a control means of the pump according to the present invention. This control means provides a function of removing the fluid discharge variation which takes place in synchronization with the cams, and forms an essential portion of the present invention.

Referring to FIG. 2, an operation means 10 is a section where the rate of discharge is set and instructions for operation modes are conducted. A pulse motor driving means 11 receives pulse rate data 13 from a control means 12, rotates the phase of the pulse motor 1 in accordance with the pulse rate data 13, and returns a phase-rotating signal 14 to the control means 12. A photointerrupter 15 detects the initial position of the cams to emit an initial position signal 16 to the control portion 12.

An A/D converter 17 convertes a discharge pressure signal 18 from the pressure sensor 22 into a digital value 19 and sends it to the control means 12. A data storing means 20 is formed by a non-volatile memory, stores compensation data 24 in accordance with memory controlling data 25 from the control means 12, and feeds compensation data 24 to the control means 12. The control means 12 is arranged to be operative in a learning mode and an analysis mode in response to the instructions from the operation means 10.

These operations will now be described with reference to FIG. 2 and the flow charts shown in FIGS. 5 and 6.

Figure 5:
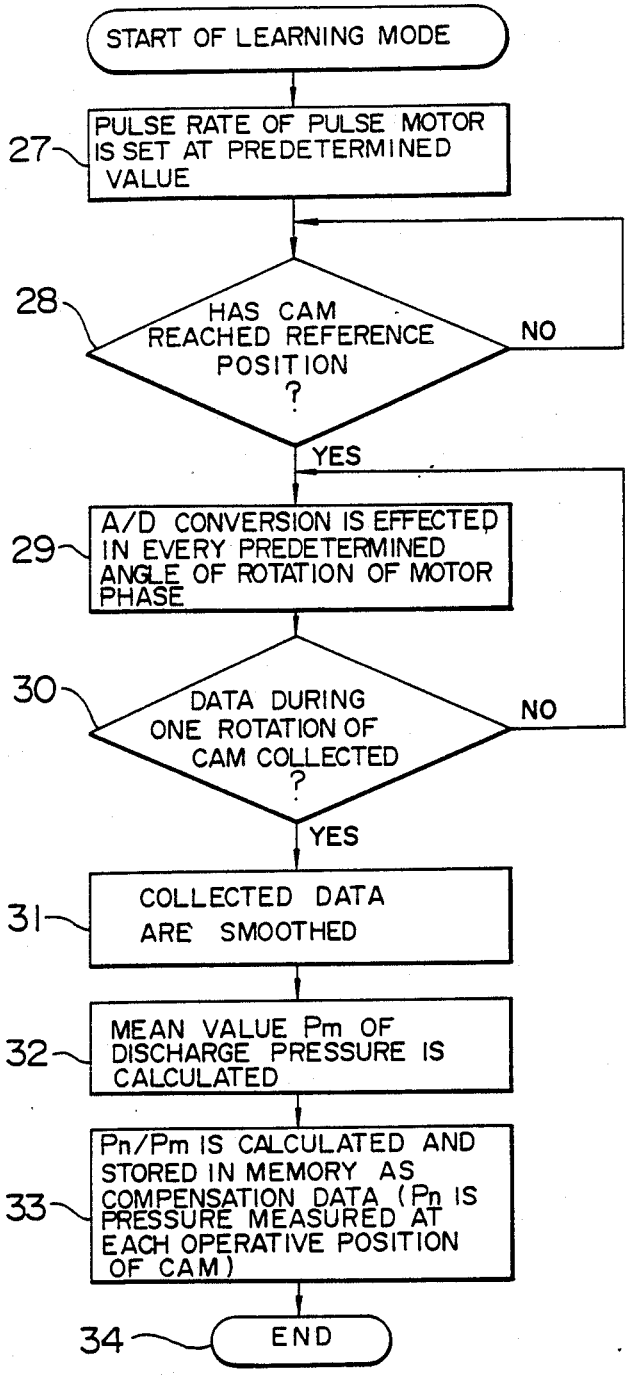
FIG. 5 is a flow chart of learning mode operation.

When the learning mode is instructed, a predetermined value is set in step 27 shown in FIG. 5 as pulse rate for the pulse motor driving means 11. In this embodiment, a value of 5 m sec is set, which is equivalent to the driving speed for a rate of discharge of 1 ml/min. As a result, the pulse motor 1 is rotated at a speed of 200 pps to give a rate of discharge of 1 ml/min.

Next, the control means 12 supervises the photointerrupter 15 and waits for the cam coming to the initial position, as shown in step 28 in FIG. 5.

When the cam has reached the initial position, the discharge pressure Pn is read (step 29 shown in FIG. 5) in every predetermined angle of rotation of the cam (every 5° in this embodiment). When the measurements of the discharge pressure during one complete rotation have been completed (step 30 shown in FIG. 5), an average value Pm of the discharge pressure per rotation is calculated (step 32 shown in FIG. 5). Assuming that the pressure data obtained during a predetermined angle of rotation of the cam is Pn, the average value Pm is given by:

$$Pm = \Sigma Pn/n.$$

On the basis of the average value Pm, a correction factor Kn for each point of the periphery of the cam is calculated (in step 33 shown in FIG. 5), as follows:

$$Kn = Pn/Pm$$

where n represents positions reached by the cam each time the cam has rotated over the predetermined angle of rotation, it being set in this embodiment as being 0 to 71.

Then, the thus obtained correction factor Kn is stored in a memory 20.

Figure 6:
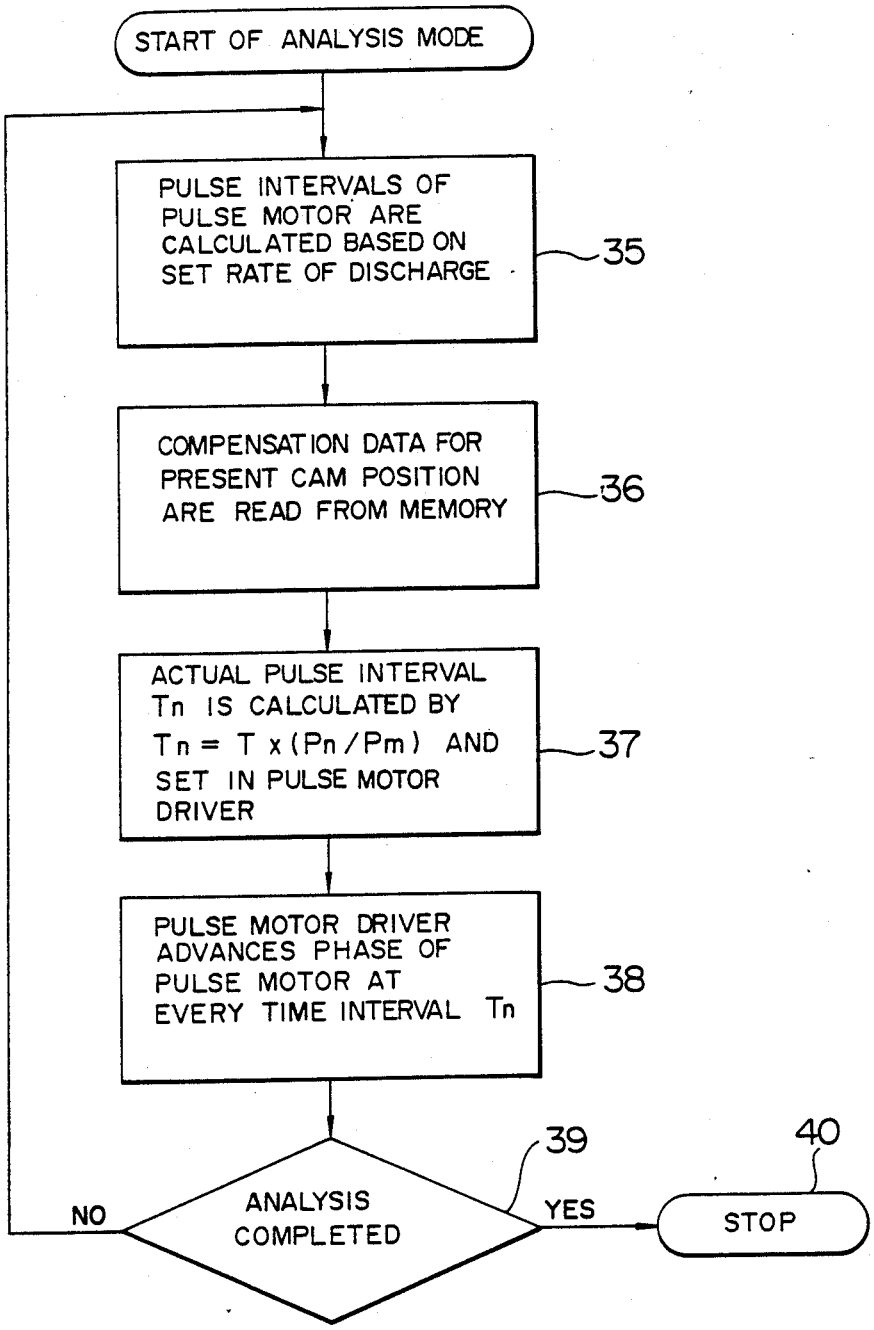
FIG. 6 is a flow chart of analysis mode operation.

In the analysis mode, when the rate of discharge is set by the operation means 10, the control means 12 calculates the drive pulse frequency for the pulse motor 1 in accordance with the thus set rate of discharge (step 35 shown in FIG. 6).

In this embodiment, $$Frg = F \times 200\ pps$$

where Frg is pulse motor drive pulse frequency and F is set rate of discharge [ml/min].

The phase rotational period T of the pulse motor 1 can be calculated by using the frequency Frg as follows:

$$T=1/Frg$$

In this embodiment, the phase rotational period T is 5/F [mS].

Then, this value is set in the pulse motor driving means 11 so that the pulse motor 1 is rotated while the control means 12 monitors the photointerrupter 15.

When an initial position signal 16 is input from the photointerrupter 15 into the control means 12, succeeding cam positions can be foreseen. Therefore, correction data Kn=Pn/Pm for each of the predetermined cam positions (in step 36 shown in FIG. 6) and, thus, an actual or corrected phase rotational period is calculated (step 37 shown in FIG. 6) as follows:

$$Tn'=Kn\times T$$

where Tn' is phase rotational period corrected.

After the control means 12 has detected the cam initial position signal 16, phase rotational periods are calculated and set at every predetermined angles (in this embodiment, every 5°)

The pulse driving means 11 rotates the pulse motor 1 by using these phase rotational periods (step 38 shown in FIG. 6).

Figure 4B:
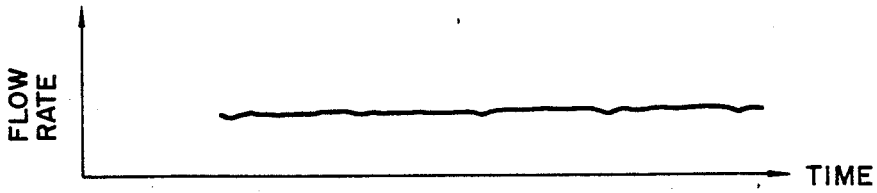

As a result, machining errors of the cams and plungers are compensated so that a stabilized rate of discharge is obtained as shown in FIG. 4B.

Since the thus compensated errors are the machining errors of the cams 2 and 3 and the plungers 4 and 5, the rate of discharge is not changed as time elapses. Therefore, the learning mode is conducted only once, and the thus-stored compensation data 24 can be used until the cams or the plungers are replaced by new ones.

Since the learning mode needs to be conducted only once, it can be conducted before delivery of the pump from a plant. Users are not required to conduct any learning mode of correction.

Therefore, control which needs to be conducted by users is limited to only the analysis mode.

Figure 7:
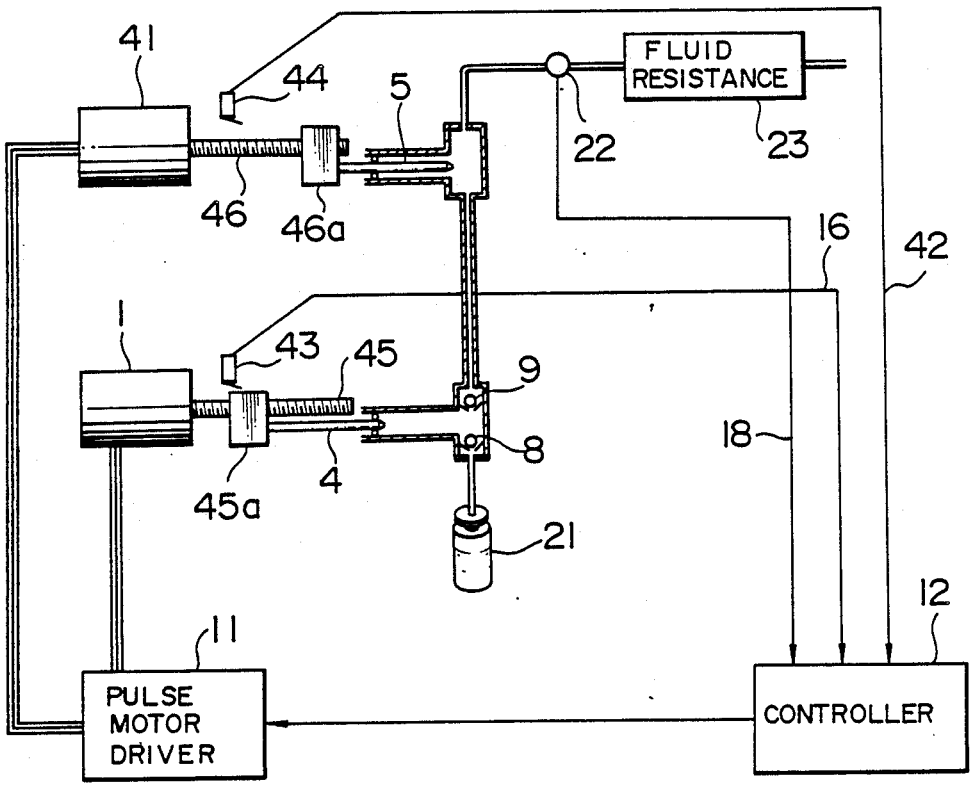
FIG. 7 is a schematic illustration of a pump according to another embodiment of the present invention.

FIG. 7 illustrates another embodiment of the present invention. In this embodiment, the plungers 4 and 5 are respectively reciprocated by feed screws 45 and 46 employed as alternatives to the cams 2 and 3 employed in the first embodiment. These feed screws 45 and 46 are each rotated and driven by reversible pulse motors 1 and 41. In order that the pump may discharge a liquid continuously, the directions of rotation of the motors 1 and 41 are alternately switched with a predermined phase difference so that sliders 45*a* and 45*b* with which the feed screws 45 and 46 are threadably engaged are alternately reciprocated to drive the plungers 4 and 5 to assure a constant rate of the sum of the discharges caused by the two plungers. Position detectors 43 and 44 in the form of limit switches are equivalent to the photointerrupter 15 described in the above-described embodiment and are respectively disposed at one end of the reciprocating movement of respective sliders 45*a* and 46*a*. The position detectors 43 and 44, therefore, detect the sliders 45*a* and 46*a* reaching the one end and issue a detection signal which is used as a reference for the measurement of errors and for correction operations.

In the feed-screw type embodiment, since the manufacturing errors of feed screws cause errors in the rate of discharge as in the case of the manufacturing errors of the cams, values set for the compensation of errors of the feed screws 45 and 46 are stored in the memory so as to conduct control in such a manner that the rotational speeds of the motors 1 and 41 are compensated at every predetermined spaced positions of the feed screws whereby the rate of discharge of the pump can be made substantially constant. The details of this control can be easily understood by those skilled in the art from the description of the method of control in the first embodiment.

Although two plungers are used in the embodiments described, a similar effect can be obtained when this invention is applied to single plunger type of fluid pump.

The invention can also be applied to pumps provided with means for correcting errors due to contraction of liquids to the pumped. More specifically, liquid suffers from volume contraction due to pressure applied, although the rates of contraction very with different kinds of liquids. Thus, a pressure reduction (discharge reduction) occurs at the time of switching of a plunger suction stroke to a plunger discharge stroke. In order to prevent such a pressure reduction, a method is generally employed in which the plunger is driven at a high speed at the time of switching of the plunger strokes from the suction movement as in disclosed, for example, in U.S. Pat. No. 4,352,636 granted Oct. 5, 1982 to Patterson, et al to the discharge movement.

In the embodiment of the invention, a method is employed in which the plungers are driven while the speeds of the plungers are compensated in accordance with correction factors throughout the overall strokes of the plungers. However, in the case of a high pressure operation, another method can be employed in which, so as to compensate for a pressure reduction, the plungers are moved at a high speed in accordance with a known compressibility of a liquid at the time of switching of the plunger strokes from the suction stroke to the discharge stroke. Movement may be by a known mechanism such as that disclosed in the above-identified U.S. Pat. No. 4,352,636. The photointerrupter 15 of the embodiment of FIGS. 1 and 2 detects the positions of the cams 12 and 13 and emits a cam initial position signal 16 to the controller 12. The controller 12 is, therefore, able to detect, by means of the signal 16, the plungers 4 and 5 when they are in suction strokes. The controller 12 is also responsive to the pump discharge pressure (which is represented by the pump discharge pressure signal 18) and operative to emit a signal to the pulse motor driver 11 so that the plunger operations are controlled, based on a known compressibility of the liquid being pumped, to compensate for any reduction in the pump discharge pressure which takes place when the plunger operations are changed from the suction strokes to the discharge strokes. The compensating control is conducted in a closed loop manner only during the part of the pump operation when a variation in the pump discharge pressure takes place due to contraction of liquid. When the compensation based on the compressibility of the liquid has been completed, the plungers can be driven at a speed determined by the correction factor stored in the memory 20 and the set rate of discharge.

As described above, according to the present invention, variation in the rate of discharge of a reciprocating type of pump due to a low machining accuracy of the cams, feed screws and plungers can be compensated for.

In addition, since there is no need to improve the machining accuracy of component parts, such as cams and plungers, pumps can be easily manufactured.

Furthermore, in the pump according to the present invention, since the learning correction needs to be conducted only once at the manufacturing plant, users do not need to conduct it. Consequently, the pump according to the present invention can be easily used since the users do not need to prepare any dummy load for a learning correction. In addition, because it is not required to conduct measurement of errors in the rate of pump discharge during an analysis operation, the pump assures a good reproducibility of analysis data and, thus, stable analysis operations.

What is claimed is:

1. A method of operating a pump of the type that includes at least one plunger and driving means for reciprocating said plunger so that a liquid is sucked and discharged by the reciprocating movements of said plunger, said method comprising:

measuring errors in the amount of driving movement per unit of time of said driving means at each of a plurality of predetermined operative positions of said plunger;

calculating a speed correction factor of said driving means for each of said plurality of predetermined operative positions in accordance with the thus measured errors, and then storing results of the calculation in a memory; and operating said driving means while the speed of said driving means is adjusted at each of said plurality of predetermined positions of said plunger in accordance with said stored speed correction factor so that said speed of said plunger is compensated substantially to meet a designed value for thereby making the rate of discharge substantially constant.

2. A method of operating a pump according to claim 1, wherein the pump discharge pressure is measured at each of said plurality of predetermined positions of said plunger, and a ratio of the thus-measured discharge pressure to a mean value of discharge pressure during one cycle of pumping operation of said plunger is stored in the memory as said speed correction factor for each of said plurality of predetermined positions of said plunger.

3. A method of operating a pump according to claim 1, wherein storing of said speed correction factor in said memory is effected during a pump manufacturing process.

4. A method of operating a pump according to claim 1, wherein said plunger is operated at a high speed regardless of said correction factor during a suction operation period and a fluid compression period in which suction stroke is switched to a discharge stroke.

5. A method of operating a pump according to claim 1, wherein said plunger is operated at a high speed regardless of said correction factor during a fluid compression period in which a suction stroke is switched to a discharge stroke.

6. A method of operating a pump according to claim 1 wherein said measured errors are due to manufacturing inaccuracies of component parts including said at least one plunger and said driving means.

7. A low pulsation displacement pump comprising:

at least one plunger;

driving means for reciprocating said plunger;

memory means which stores therein a speed correction factor of said driving means for each of a plurality of predetermined operative positions of said plunger, said speed correction factor having been calculated in accordance with errors in the amount of driving movement per unit of time of said driving means at each of said plurality of predetermined positions of said plunger; and control means for controlling the speed of said driving means in accordance with said speed correction factor, said control means being operative to actuate said driving means so that the speed of said driving means is adjusted at each of said plurality of predetermined positions of said plunger in accordance with said speed correction factor stored in said memory means so that the speed of said plunger is compensated substantially to a designed value and the rate of discharge of said pump is kept substantially constant.

8. A low pulsation displacement pump according to claim 7 wherein said errors in the amount of driving movement per unit of time of said driving means are due to manufacturing inaccuracies of component parts including said at least one plunger and said driving means.

9. A low pulsation displacement pump according to claim 7, further comprising measuring means for measuring pump discharge pressure at each of said plurality of predetermined positions of said plunger and means for calculating the error in the driving movement of said driving means, said error calculating means calculating a ratio of the thus-measured discharge pressure to a mean value of discharge pressure during one pumping cycle of said plunger and storing the thus calculated ratio in said memory as the speed correction factor for each of said plurality of predetermined positions of said plunger.

10. A low pulsation displacement pump according to claim 7, wherein said plunger comprises two plungers and said driving means comprises one pulse motor and two cams rotated by said motor to drive said two plungers, respectively.

11. A low pulsation displacement pump according to claim 7, wherein said plunger comprises two plungers and said driving means comprises two pulse motors, two feed screws rotated by said motors, and sliders reciprocated by said feed screws to drive said plungers in a reciprocated manner, respectively.

* * * * *